US005265743A

United States Patent [19]

Frohn

[11] Patent Number: 5,265,743

[45] Date of Patent: Nov. 30, 1993

[54] STACKABLE PLASTIC CONTAINER

[76] Inventor: Walter Frohn, Geiselgasteigstr. 100, 800 München 90, Fed. Rep. of Germany

[21] Appl. No.: 839,578

[22] Filed: Feb. 21, 1992

[51] Int. Cl.[5] ..... B65D 21/00

[52] U.S. Cl. ..... 215/10; 215/1 C; 215/100 A; 220/771; 220/768; 206/510; D9/523; D9/526; D9/535

[58] Field of Search ..... 215/10, 1 C, 100 A; 220/380, 771, 770, 768, 761, 752; 206/503, 510; 222/143; D9/523, 526, 527, 528, 530, 531, 535

[56] References Cited

U.S. PATENT DOCUMENTS

| | | | |
|---|---|---|---|
| D. 59,407 | 10/1921 | Brown | D9/527 X |
| 4,351,454 | 9/1982 | Maynard, Jr. | 222/143 |
| 4,541,529 | 9/1985 | Hestehave et al. | 220/771 X |
| 4,881,647 | 11/1989 | Schiemann | 206/510 |

FOREIGN PATENT DOCUMENTS

| | | |
|---|---|---|
| 0235348 | 8/1986 | European Pat. Off. . |
| 0266851 | 11/1987 | European Pat. Off. . |
| 3224038 | 12/1983 | Fed. Rep. of Germany . |
| 8700445 | 1/1987 | Fed. Rep. of Germany . |

*Primary Examiner*—Allan N. Shoap
*Assistant Examiner*—Paul A. Schwarz
*Attorney, Agent, or Firm*—Robert W. Becker & Associates

[57] ABSTRACT

A stackable plastic container, manufactured as one piece in a blow molding process and designed for transporting hazardous liquids has a parallelepipedal form with rounded corners and edges. The container is provided with a U-shaped protruding stacking surface with two legs, whereby the legs in the direction are sloped toward the front wall in a downward direction toward the upper corners of the lateral edges of the front wall to a point below the shoulder of the filling and pouring socket arranged at the front wall and from there in an upward slope toward the shoulder of the socket.

7 Claims, 4 Drawing Sheets

STACKABLE PLASTIC CONTAINER

BACKGROUND OF THE INVENTION

The present invention relates to a stackable plastic container and especially suitable for transporting hazardous liquids manufactured as one piece in a blow molding process. The container has the form of a parallelepiped with rounded corners and edges and is provided with a handle at its top portion. Within the top portion, in the vicinity of the front wall, the container is also provided with a filling and pouring socket. A U-shaped stacking surface protrudes from the top portion and surrounds the handle. It has a planar contact surface for receiving further identical containers to be stacked thereon. The U-shaped stacking surface is comprised of two parallel legs and a stacking shoulder which is arranged opposite the filling and pouring socket.

Such containers must fulfill the government regulations for the transport of hazardous materials by railway, highways or sea, such as the code on hazardous material for transportation by railways, highways, sea for Germany. Corresponding international laws exist everywhere in the world. The testing methods provided in the code establish very strict requirements concerning the mechanical and chemical stability of such containers, especially after a long-time chemical exposure to hazardous liquids such as peroxides for which the containers are to be certified. The chosen terminology "containers for transporting hazardous liquids" is to be understood such that they fulfill the requirements of the test methods denoted above.

Furthermore, it will be a future requirement for such container that they must be disposed such as to be emptied completely since the respective recycling or reclamation facilities will only accept containers in which no small amounts of liquid contained therein will be retained.

The embodiment of such containers with rounded corners and edges is for example disclosed in European Patent Application 0 235 384 and have the advantage of a great mechanical stability in comparison to containers with right angle edges which are known from European Patent Application 0 266 851. With right angle edges, corrosive rupture resulting from chemical exposure to hazardous filling materials frequently occur. Both types of containers, however, have the disadvantage that stacking caps are required.

In the aforementioned containers and in such containers as disclosed in German Utility Model 87 00 445 and in German Patent Application 32 24 038, the legs of the U-shaped stacking surface of the top portion of the container are shortened in the area of the pouring socket and are sloped downward towards the connection of the pouring socket to the top portion. Accordingly, the front wall which is adjacent to the pouring socket intersects an imaginary horizontal plane through the container at the elevation of the connection of the pouring socket to the top portion. When the aforementioned containers are tilted to the side during the pouring step, which is essentially unavoidable, a small amount of liquid will remain within the lower portions of the container shoulder; the container cannot be emptied completely.

It is therefore an object of the present invention to provide a container which fulfills to the requirements of the transportation code for hazardous materials even under extreme conditions and which may be emptied completely even when tilted sideways which happens almost inevitably during the pouring step.

BRIEF DESCRIPTION OF THE DRAWINGS

This object and other objects and advantages of the present invention, will appear more clearly from the following specification in conjunction with the accompanying drawings, in which.

SUMMARY OF THE INVENTION

The stackable plastic container of the present invention is primarily characterized by a bottom portion, a top portion, a front wall and a back wall and two side walls forming a parallelepiped, the parallelepiped having rounded corners and edges with a mold center plane dividing the parallelepiped through the front wall, the back wall, the top portion and the bottom portion; a handle protruding upwardly from the top portion; a filling and pouring socket protruding upwardly from the top portion in an area adjacent to the front wall, the filling and pouring socket having a shoulder where the top portion and the filling and pouring socket meet; a cap for closing the filling and pouring socket; a U-shaped stacking surface protruding upwardly from the top portion and surrounding the handle, the stacking surface having a planar contact surface for receiving thereon a further identical container, the U-shaped stacking surface comprising legs extending parallel to the mold center plane and a stacking shoulder connecting the legs and being arranged opposite the filling and pouring socket; and sloped inwardly curved surface areas extending from free ends of the legs in a downward slope toward lateral portions of the front wall adjacent to the side walls to an elevation below the shoulder and extending in an upward slope from the lateral portions to the shoulder of the pouring socket. The sloped inwardly curved surface areas extending from free ends of the legs each have a generally flat downwardly sloping portion extending toward a transition area where the front wall and the side wall merge together, the transition area being at an elevation below the forward shoulder, and a portion curving upwardly from the transition area to the forward shoulder.

It is expedient that the sloped inwardly curved surface area essentially form a plane within a section extending between the legs and the top portion. Preferably, the plane of the sloped inwardly curved surface areas, in the section between the legs and the top portion, extends approximately vertically. In a preferred embodiment, the plane extends at an acute angle relative to the mold center plane toward the filling and pouring socket. In another preferred embodiment, the plane extends at an obtuse angle relative to the mold center plane toward a respective one of the side walls.

It is advantageous that the filling and pouring socket be forwardly positioned such that it protrudes relative to a vertical extension of the front wall, the front wall having a bulge to form a transition to the filling and pouring socket, the legs of the stacking surface being respectively forwardly elongated.

It is furthermore expedient that a top surface of the cap, when in a closing position, is located in a same plane with the stacking surface.

DESCRIPTION OF PREFERRED EMBODIMENTS

The present invention will not be described in detail with the aid of several specific embodiments utilizing FIGS. 1 through 6.

Figure 1:
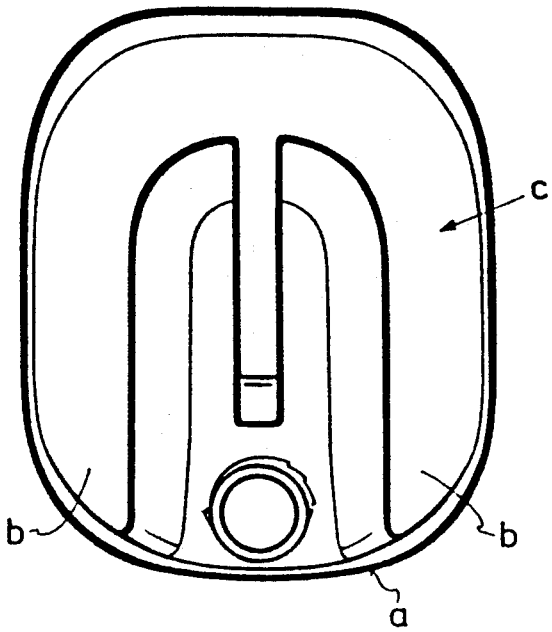
Fig. 1 Prior Art
FIG. 1 shows a top view of a prior art container.
Figure 2:
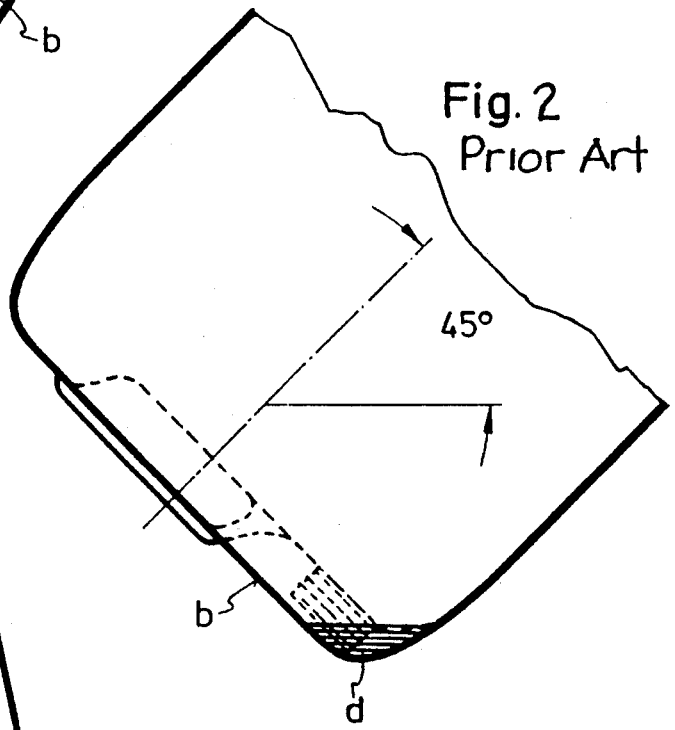
Fig. 2 Prior Art
FIG. 2 shows a side view of the container of FIG. A in a pouring position.
Figure 3:
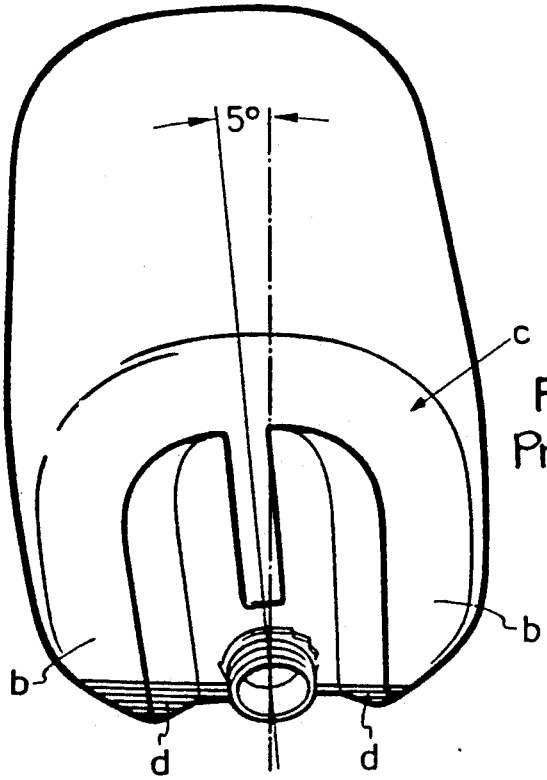
Fig. 3 Prior Art
FIG. 3 shows an end view of the container of FIG. A in the pouring position.

FIGS. 1, 2 and 3 represent a container of the prior art.

The prior art container represented in FIGS. A, B and C is provided with legs that extend to the front wall a of the container, with the stacking surface c protruding at the same level over the entire top portion. When this container is emptied, a small amount of liquid will remain within the area at the end of the legs b whereby this small amount may not be emptied even when the container is tilted, as is demonstrated in FIGS. 2 and 3 (cross-hatched portion d).

Figure 4:
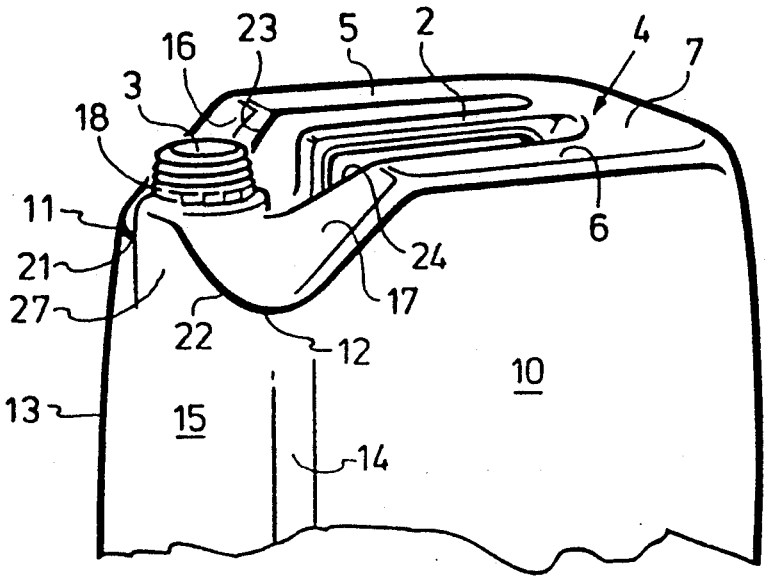
FIG. 4 shows the inventive container in a perspective representation.

The inventive container, represented in a perspective view in FIG. 4, has a parallelepipedal form with strongly rounded corners and edges which provide a great mechanical stability to the container. The container is manufactured in a blow molding process in a known manner whereby the mold center plane 1, represented as a dash-dotted line, divides the container in the direction of the handle 2 and through the axis of the filling and outlet socket 3. The stacking surface 4 is comprised of the two legs 5 and 6 and the stacking shoulder 7 which is arranged opposite the filling and pouring socket 3. The stacking surface 4 protrudes from the top portion 8 of the container 8.

The legs 5 and 6 extend to about $\frac{3}{4}$ of the width of the side walls 9 and 10 and then extend in a downward orientation to form the sloped inwardly curved surface areas 16 and 17, thus extending to the upper corners 11 and 12 of the rounded edges or lateral portions 13 and 14 of the slightly curved front wall 15 to a level below the shoulder 18 of the filling and pouring socket 3 and from there extending upwardly to this shoulder 18. The sloped inwardly curved surface areas 16, 17 have a sloped portion **16*a*, 17*a* essentially forming a plane within a section extending between the legs 5, 6 and the top portion 8. The inner edges 19, 20 of these sloped inwardly curved surface areas 16 and 17 have a lesser slope at the level of the top portion 8, while the outer edges 21 and 22, at their lowest point at the corners 11 and 12, have a depth which corresponds approximately to twice the distance between the top portion 8 and the stacking surface 4**.

The sloped inwardly curved surface areas 16, 17 extending from free ends of the legs 5, 6 each have a generally flat downwardly sloping portion extending toward a transition area where the front wall 15 and the side wall 10 merge together, the transition area being at an elevation below the forward shoulder 18, and a portion curving upwardly from the transition area to the forward shoulder 18.

Due to this embodiment of the sloped inwardly curved surface areas 16 and 17, the inner space of the legs 5 and 6 defined by these surface areas 16, 17 are arranged above the shoulder 18 of the filling and pouring socket 3 during the pouring step. In this pouring position they (16 17) extend in a downward slope towards the filling and pouring socket 3 without a retaining obstacle being present. Accordingly, the container may be completely emptied in a reliable manner even when it is tilted at a greater angle to the side which usually occurs during pouring.

Figure 5:
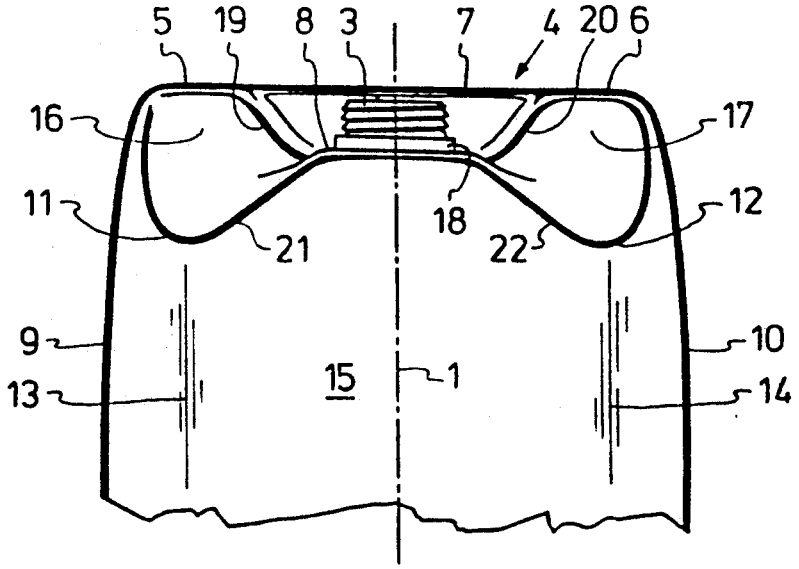
FIG. 5 shows an end view of the container of FIG. 1.
Figure 6:
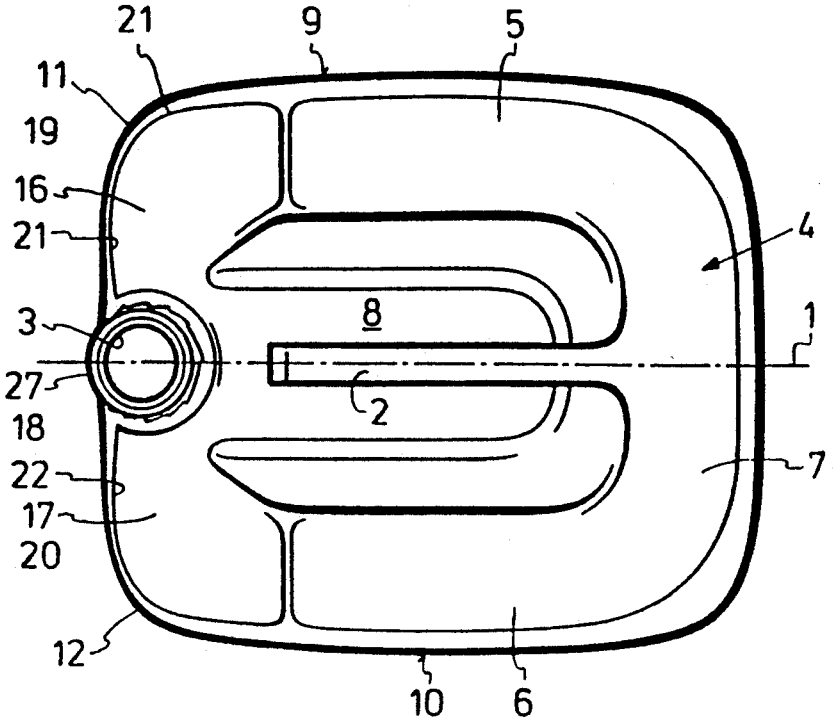
FIG. 6 shows a plan view of the top portion of the container of FIG. 1.

The inwardly curved sloped surface areas 16, 17 may have a relatively flat sloped portion **16*a*, 17*a* from the stacking surface 4 to the level of the top portion 8, or, as can be seen in FIGS. 5 and 6, may be provided with a forward edge 23, 24 of the leg extending approximately perpendicular to the mold center plane. This forward edge 23, 24 as can be seen in FIG. 5, may be rotated towards the filling and pouring socket 3 or towards the side walls 9, respectively, 10, so that the edges 23, 24 are arranged at the position indicated by 25, 26, i.e., the forward edges 23, 24 extend at an acute angle (FIG. 5) or an obtuse angle (FIG. 6**) relative to the mold center plane toward the filling and pouring socket.

As can be seen from FIG. 4, the filling and pouring socket 3 may be displaced in a forward direction relative to the front wall 15 whereby a bulge 27 forms the transition from the front wall 15 to the socket 3. With this measure, the shoulder 18 of the filling and pouring socket 3, in the pouring position of the container, is lowered and, at the same time, the legs 5 and 6 of the stacking surface 4 may be displaced in a forward direction in order to provide an improved contact surface for further identical containers stacked thereon.

Figure 7:
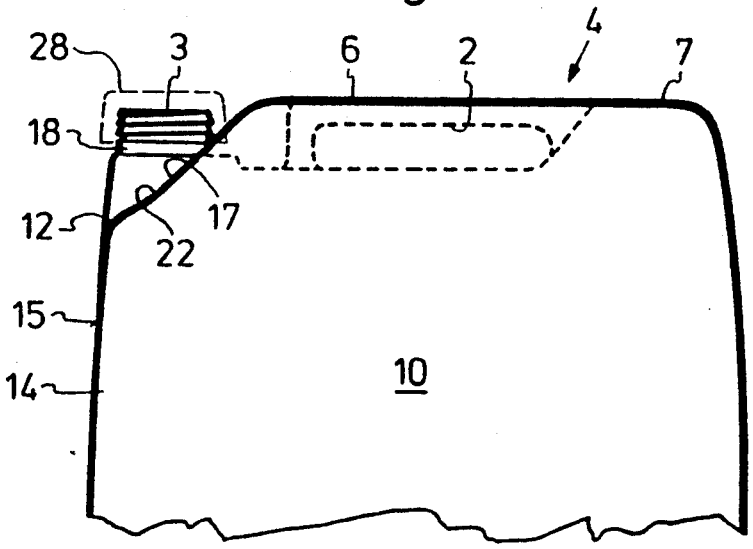
FIG. 7 shows a partial side view of the container of FIG. 1.
Figure 8:
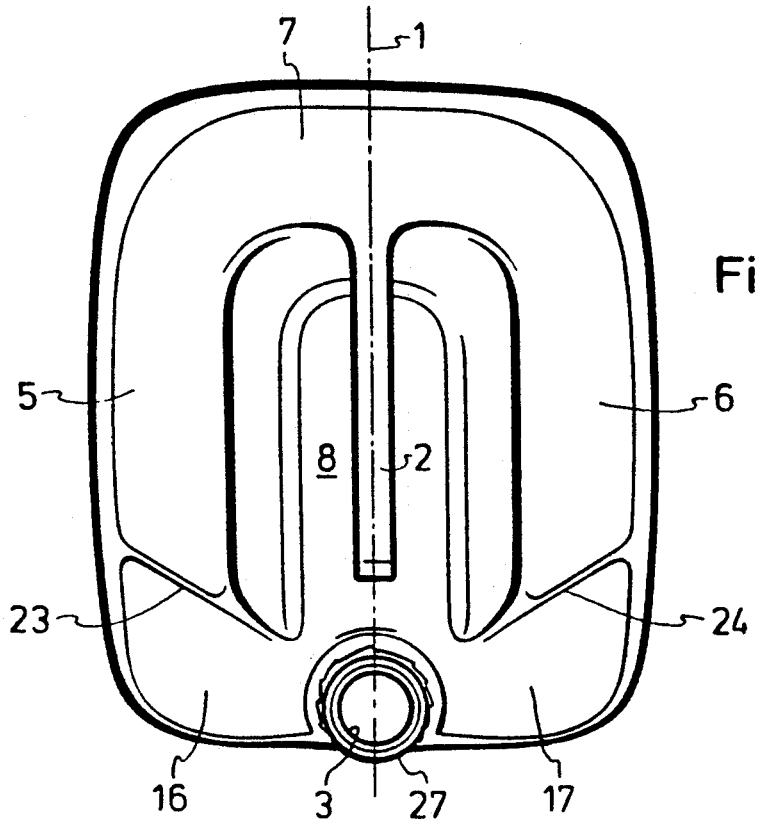
FIG. 8 shows another embodiment of the inventive container in a plan view and a perspective view.
Figure 9:
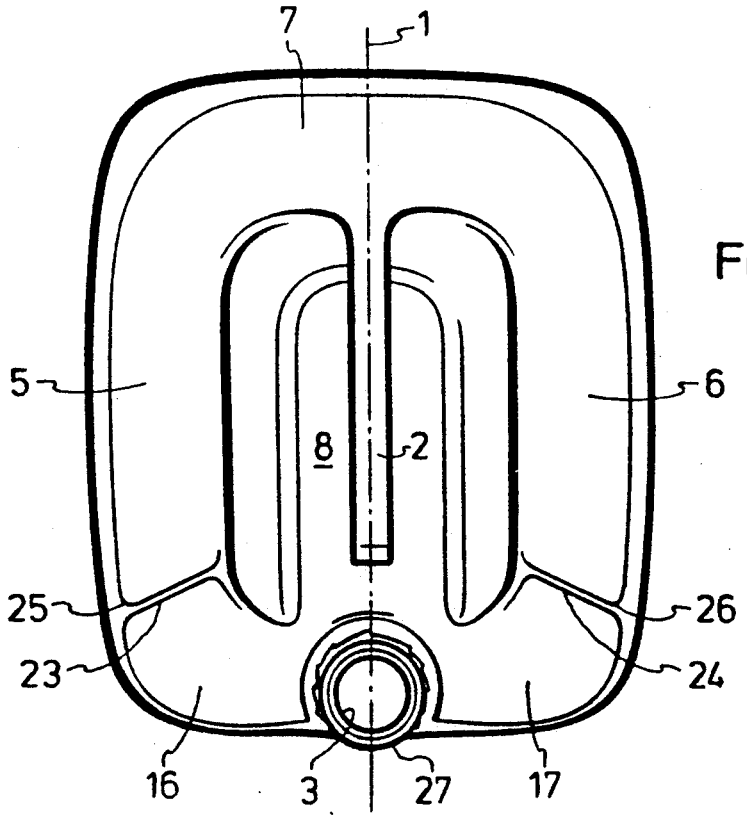
FIG. 9 shows a further embodiment of an inventive container in a plan view and a perspective view.

The stacking surface 4 of the container may be provided in a known manner with respective recesses, for example, in the form of grooves that extend transverse to the longitudinal extension of the legs and which then correspond to respective projections at the bottom portion of an identical container for engagement during the stacking step. It is thus prevented that the upper container may slide off the lower container in the direction towards the filling and pouring socket 3 due to the sloped ends of the legs 5, 6. In order to avoid such a sliding, the filling and pouring socket 3 may be extended such that the top surface of a closing cap 28 when screwed onto the socket is in the same plane as the stacking surface 4 (see FIG. 7).

The present invention is, of course, in no way restricted to the specific disclosure of the specification and drawings, but also encompasses any modifications within the scope of the appended claims.

What I claim is:

1. A stackable plastic container, manufactured as one piece in a blow molding process, for transporting hazardous liquids, said container comprising:

a bottom portion, a top portion, a front wall and a back wall and two side walls, forming a parallelepiped, said parallelepiped having rounded corners and edges, with a mold center plane dividing said parallelepiped through said front wall, said back wall, said top portion and said bottom portion;

a handle protruding upwardly from said top portion;

a filling and pouring socket protruding upwardly from said top portion in an area adjacent to said front wall, said filling and pouring socket having a forward shoulder at said front wall where said top portion and said filling and pouring socket meet;

a cap for closing said filling and pouring socket;

a U-shaped stacking surface protruding upwardly from said top portion and surrounding said handle, said stacking surface having a planar contact surface for receiving thereon a further identical said container, said U-shaped stacking surface comprising legs extending parallel to said mold center plane and a stacking shoulder connecting said legs and being arranged opposite said filling and pouring socket; and sloped inwardly curved surface areas extending from free ends of said legs, each of said sloped inwardly curved surface areas having a generally flat downwardly sloping portion extending toward a transition area where said front wall and said side wall merge together, said transition area being at an elevation below said forward shoulder, and a portion curving upwardly from said transition area to said forward shoulder.

2. A container according to claim 1, wherein said sloped curved surface areas each have a sloped portion essentially forming a plane within a section extending between said legs and said top portion.

3. A container according to claim 2, wherein each of said sloped portions include a forward edge extending approximately perpendicular to the mold center plane.

4. A container according to claim 3, wherein each of said forward edges extend at an acute angle relative to said mold center plane toward said filling and pouring socket.

5. A container according to claim 3, wherein each of said forward edges extend at an obtuse angle relative to said mold center plane toward a respective one of said side walls.

6. A container according to claim 1, wherein said filling and pouring socket is forwardly positioned such that it protrudes relative to a vertical extension of said front wall, said front wall having a bulge to form a transition to said filling and pouring socket, said legs of said stacking surface being respectively forwardly elongated.

7. A container according to claim 1, wherein a top surface of said cap, when in a closing position, is located in a same plane with said stacking surface.

* * * * *

UNITED STATES PATENT AND TRADEMARK OFFICE

CERTIFICATE OF CORRECTION

PATENT NO. : 5,265,743

DATED : November 30, 1993

INVENTOR(S) : Walter Frohn

It is certified that error appears in the above-identified patent and that said Letters Patent is hereby corrected as shown below:

On the title page:

[30] Foreign Application Priority Data
Feb. 25, 1991 [DE] Fed. Rep. of Germany .... 9102198

Signed and Sealed this

Third Day of May, 1994

Bruce Lehman

*Attest:*

BRUCE LEHMAN

*Attesting Officer*

*Commissioner of Patents and Trademarks*